US011824318B2

(12) United States Patent
Rutz et al.

(10) Patent No.: US 11,824,318 B2
(45) Date of Patent: Nov. 21, 2023

(54) BUSBAR AND BUSBAR ASSEMBLY FOR AN ELECTRICAL CONDUCTOR

(71) Applicant: Weidmüller Interface GmbH & Co. KG, Detmold (DE)

(72) Inventors: Andreas Rutz, Bielefeld (DE); Frank Hackemack, Detmold (DE); Karlo Stjepanovic, Bielefeld (DE); Jürgen Ziemke, Detmold (DE); Stefan Fischer, Detmold (DE); Marco Waldhoff, Steinheim (DE); Jörg Münstermann, Schlangen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 312 days.

(21) Appl. No.: 17/264,554

(22) PCT Filed: Sep. 5, 2019

(86) PCT No.: PCT/EP2019/073759
§ 371 (c)(1),
(2) Date: Jan. 29, 2021

(87) PCT Pub. No.: WO2020/053072
PCT Pub. Date: Mar. 19, 2020

(65) Prior Publication Data

US 2021/0320435 A1 Oct. 14, 2021

(30) Foreign Application Priority Data

Sep. 14, 2018 (DE) ..... 202018105269.1

(51) Int. Cl.
*H01R 4/48* (2006.01)
*H01R 4/30* (2006.01)
(Continued)

(52) U.S. Cl.
CPC ..... *H01R 4/4818* (2013.01); *H01R 4/30* (2013.01); *H01R 11/11* (2013.01); *H01R 43/16* (2013.01)

(58) Field of Classification Search
CPC ..... H01R 4/4818; H01R 4/30; H01R 11/11; H01R 43/16
(Continued)

(56) References Cited

U.S. PATENT DOCUMENTS 2,381,331 A 8/1945 Ayers
2,953,771 A 9/1960 Kussy
(Continued)

FOREIGN PATENT DOCUMENTS

CN 1126530 A 7/1996
CN 103531932 A 1/2014
(Continued)

*Primary Examiner* — Peter G Leigh
(74) *Attorney, Agent, or Firm* — LAUBSCHER & LAUBSCHER, P.C.

(57) ABSTRACT

A busbar for electrically contacting an electrical conductor has two mutually opposing side walls and a bearing wall for the electrical conductor. The bearing wall extends between the side walls and transversely or substantially transversely to same, wherein the side walls and the bearing wall extend in an insertion direction and define a receiving space for receiving the electrical conductor. At least one electrically conductive projection is provided on one of the side walls and/or the bearing wall. The width of the projection is less than the width of the bearing wall.

8 Claims, 6 Drawing Sheets

(51) Int. Cl.
*H01R 11/11* (2006.01)
*H01R 43/16* (2006.01)

(58) Field of Classification Search
USPC ..... 439/441
See application file for complete search history.

(56) References Cited

U.S. PATENT DOCUMENTS

| | | | | | |
|---|---|---|---|---|---|
| 3,239,918 | A | | 3/1966 | Cobaugh | |
| 4,213,669 | A | | 7/1980 | Wittes et al. | |
| 5,393,932 | A | * | 2/1995 | Young | H01R 4/723 228/56.3 |
| 7,275,969 | B2 | * | 10/2007 | Fukaya | H01R 13/113 439/851 |
| 8,187,043 | B2 | * | 5/2012 | Kumakura | H01R 43/048 439/882 |
| 8,963,006 | B2 | * | 2/2015 | Kuwayama | H01R 4/188 174/113 A |
| 9,065,190 | B2 | * | 6/2015 | Kuwayama | H01R 4/188 |
| 9,461,373 | B2 | * | 10/2016 | Hoppmann | H01R 4/4818 |
| 9,843,120 | B2 | * | 12/2017 | Matsushita | H01R 13/11 |
| 2010/0105257 | A1 | * | 4/2010 | Kumakura | H01R 43/048 29/874 |
| 2011/0073365 | A1 | * | 3/2011 | Kuwayama | H01R 4/188 174/84 C |
| 2012/0214361 | A1 | * | 8/2012 | Endo | H01R 4/203 439/882 |
| 2015/0357726 | A1 | | 12/2015 | Hoppmann et al. | |

FOREIGN PATENT DOCUMENTS

| | | | | | |
|---|---|---|---|---|---|
| DE | 1290211 | B | | 3/1969 | |
| DE | 217938 | A1 | | 1/1985 | |
| DE | 102011087584 | A1 | | 6/2013 | |
| DE | 202012102732 | U1 | | 10/2013 | |
| DE | 102013000713 | A1 | | 7/2014 | |
| DE | 102015108630 | A1 | | 12/2016 | |
| EP | 3182519 | A1 | | 6/2017 | |
| FR | 2858118 | A1 | | 1/2005 | |
| GB | 2192101 | A | * | 12/1987 | H01R 4/2495 |
| JP | 2009123621 | A | * | 6/2009 | |
| JP | 2009181777 | A | * | 8/2009 | |
| JP | 2011096452 | A | * | 5/2011 | H01R 4/185 |
| WO | WO-9528749 | A1 | * | 10/1995 | H01R 4/20 |
| WO | WO-2011052549 | A1 | * | 5/2011 | H01R 4/185 |
| WO | WO-2011129333 | A1 | * | 10/2011 | H01R 4/185 |

* cited by examiner

BUSBAR AND BUSBAR ASSEMBLY FOR AN ELECTRICAL CONDUCTOR

This application is a § 371 National Stage Entry of International Patent Application No. PCT/EP2019/073759 filed Sep. 5, 2019. Application No. PCT/EP2019/073759 claims priority of DE 20 2018 105 269.1 filed Sep. 14, 2018. The entire content of these applications is incorporated herein by reference.

BACKGROUND OF THE INVENTION

The present invention relates to an electrical busbar for electrically contacting an electrical conductor, a conductor terminal having such a busbar as well as an electrical assembly having such a conductor terminal.

It is common to use spring force connections or screwed connections as crimp-type connections to connect electrical conductors to electrical assemblies, particularly in push-in technology. In this case, a busbar is provided for electrically contacting the electrical conductor, which busbar is generally U-shaped. It is also known to form the busbar at least partially or entirely in a V-shape in order to center the electrical conductor in the busbar. In the case of stranded conductors, however, an unfavorable or improper positioning of the lead portion of the conductor can result, in which only a small part of the strands electrically contact the busbar and therefore lessen the current-carrying ability of the busbar.

The present invention was developed to improve the electrical contact of an electrical conductor with such a busbar so that the entire conductor contributes to the current-carrying function so that as many strands of stranded conductors as possible contribute to the current-carrying function and/or in that the contact force is improved.

To this end, a busbar is provided for electrically contacting an electrical conductor. It is preferably provided for contacting stranded conductors, but it can also be used for solid wires.

SUMMARY OF THE INVENTION

The busbar has two opposing side walls and preferably a bearing wall for the electrical conductor. The bearing wall extends between the side walls and transversely or substantially transversely to the side walls. The side walls are preferably arranged at a right angle to the bearing wall. But they can also be arranged at another angle to this wall, particularly at an obtuse angle and/or particularly at an angle between 75° and 115°.

The side walls and the bearing wall extend in an insertion direction and define a receiving space or chamber for receiving the electrical conductor.

The busbar is characterized in that at least one or more preferably electrically conductive elevations or projections are arranged on the bearing wall, wherein the width of the one or more projections or of the projections as a group overall is smaller than the width of the bearing wall.

The edges at which the projections extend from the surrounding bearing wall are then individually or altogether spaced from the edges of the bearing wall. The projection or projections on the edge of the bearing wall do not transition to another wall adjacent to the bearing wall.

The electrically conductive projection creates new conductor bearing points for an electrical conductor on the busbar. The projection disturbs the arrangement inside the lead portion of the conductor and the position of individual strands in the lead portion. This causes a movement in the lead portion if an electrical conductor is inserted in the busbar. The strands rub against each other, such that foreign layers on the strands are broken up and contact between the strands is improved. The movement also causes a rearrangement of the strands, due to which more strands are contacted. The projection causes the conductor to be elevated for conductors that have very fine wires of solid wires. This increases the contact force applied to the conductor by a terminal spring and improves contact.

In a preferred embodiment, the side walls and the bearing wall are connected to each other. In this embodiment, the busbar is substantially U-shaped. The projection can also cause off-center arrangement of the conductor in the busbar if a thin conductor is used. In thick conductors, it can cause a regrouping and changed strand arrangement in the lead portion.

A connecting wall is preferably provided between one of the side walls and the bearing wall, which connecting wall extends at an acute angle to the bearing wall and connects the bearing wall to the respective side wall. In this embodiment, the busbar includes a portion which is roughly V-shaped. Since the connecting walls are connected to each other by the bearing wall, the bearing wall forms a flattened tip of the V-shaped portion. In this configuration of the busbar, an electrical conductor, particularly a thin one, is either pressed between the projection and the connecting wall, such that it is arranged off center. Or the projection causes individual strands to group around it such that overall more strands are contacted.

Preferably, the busbar is made in one piece, particularly as a punched and bent component. The projection is likewise formed in one piece with the walls, particularly the bearing wall, of the busbar. In this way, it cannot detach from the busbar when an electrical conductor is inserted. Preferably, the busbar is made of a well-conducting material, preferably copper or a copper alloy. Alternatively, the busbar can also be made of multiple pieces, for example using a welding process.

It is further preferred that the projection is arranged at the end of the busbar in the insertion direction.

The projection is oval, elliptical, round, or drop-shaped. It can for example rise from a substantially oval, elliptical, round or drop-shaped base surface and be tapered towards and rounded at the top. For a circular base surface, this will result, for example, in the shape of a spherical segment. It is furthermore preferred that the projection is configured as a web that extends against a pressing direction, which extends transversely to the insertion direction. Other embodiments of the projection which disturb the strands of a lead portion of the electrical conductor are preferred as well. An elliptical or drop-shaped design, particularly of the type of a longitudinal bump, are preferred. In this way, the projection has a ramp which slowly rises in the insertion direction, such that the strands are gradually directed onto the projection. It is further preferred that the projection is flattened. In a transverse direction to the insertion direction, the projection therefore includes steeply dropping flanks or sides next to the flattened portion, on which flanks the strands can slide off. This shape has proven its value for grouping the strands around the projection. Preferably, an individual projection is therefore narrower than the conductor to be contacted perpendicular to the conductor insertion direction, particularly narrower than a multi-strand conductor to be connected.

Due to the projection, more strands are contacted, and/or strands are contacted at a greater contact force, with the busbar. The connection therefore has improved current carrying capacity.

The problem is further solved by a conductor terminal having such a busbar. The conductor terminal is preferably configured as a spring force connection, particularly in push-in technology. It preferably includes a terminal spring for clamping the electrical conductor in the receiving space of the busbar, which acts as a compression spring. The invention can also be used for other connection types, such as other spring terminals, screw terminals, or tension bracket terminals.

In a preferred embodiment, the terminal spring of the conductor terminal includes a clamping leg with a contour which substantially corresponds to an inner contour of the receiving space. As a result, the clamping leg can extend across the receiving space if the conductor terminal is empty, that is, as long as no electrical conductor is inserted in the conductor terminal. A contact edge arranged at the outer end of the terminal spring can then be brought into contact with the bearing wall of the busbar. This configuration allows clamping of even very thin conductors in the conductor terminal.

The conductor terminal can include a stop for the electrical conductor which limits the insertion of the electrical conductor into the conductor terminal.

The invention further relates to an electrical assembly having such a conductor terminal. The electrical assembly preferably is a series connecting terminal.

BRIEF DESCRIPTION OF THE FIGURES

Other objects and advantages of the invention will become apparent from a study of the following description when viewed in the light of the accompanying drawing, in which.

DETAILED DESCRIPTION

Figure 1A:
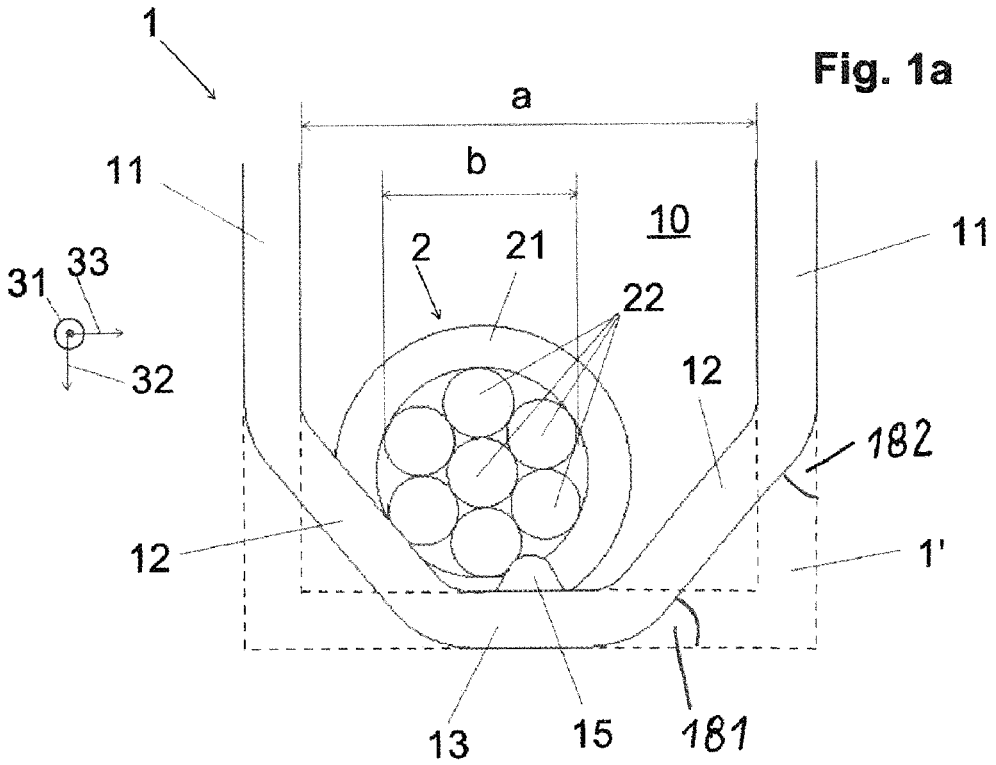
FIGS. 1*a*-1*c* are end views of different portions, respectively, of a busbar according to the invention with a thin stranded conductor inserted in the busbar.
Figure 1B:
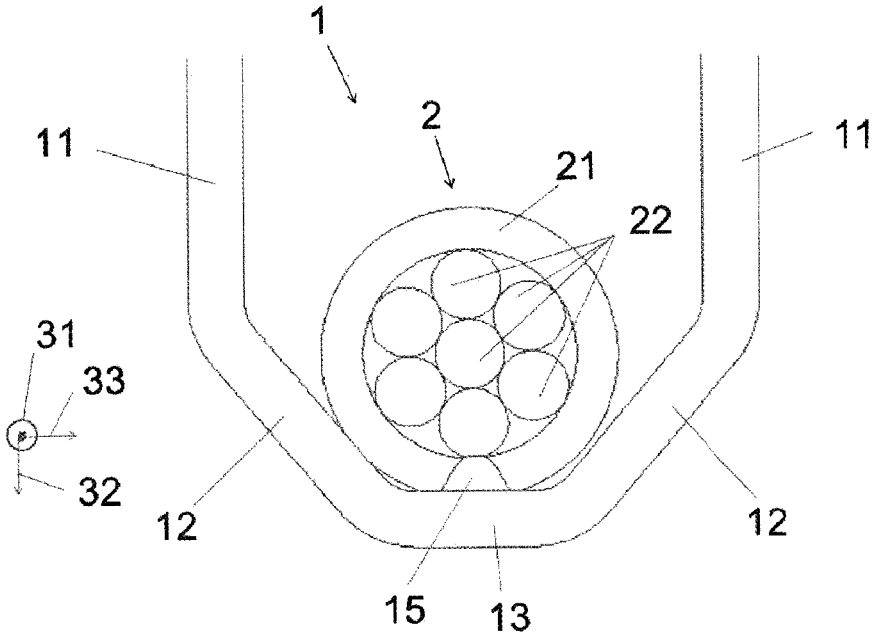
Figure 1C:
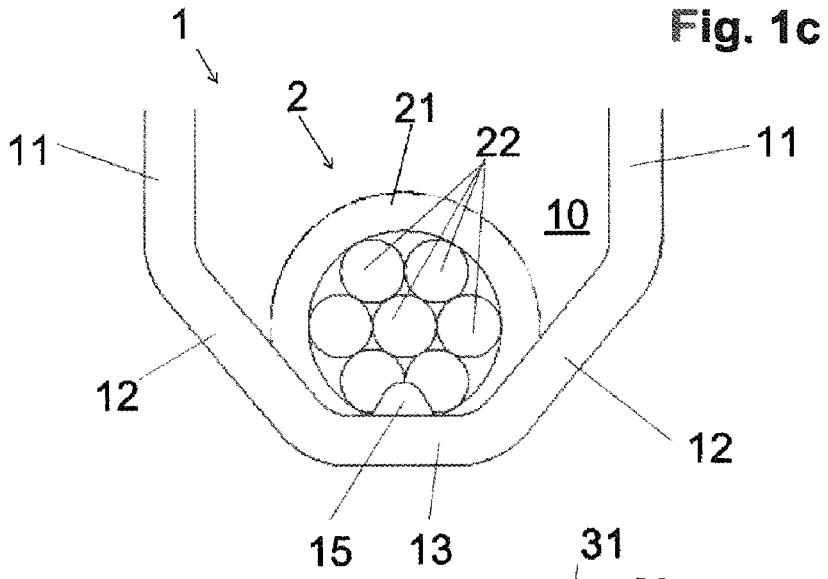

FIGS. 1*a*-1*c* show respective portions of a busbar 1 according to the invention with a thin stranded conductor 2 inserted. The busbar 1 includes two mutually opposing, in this case parallel, side walls 11, each extending parallel to an insertion direction 31 and a pressing direction 32. Furthermore, the busbar 1 includes a bearing wall 13, which extends transversely to the side walls 11, particularly parallel to the insertion direction 31 and in a transverse direction 33 between the same.

An alternate embodiment of the busbar 1' in which the side walls 11 are directly connected to the bearing wall 13 is outlined in dashed lines only as shown in FIG. 1*a*. This alternate embodiment of the busbar 1 is therefore U-shaped.

The solid lines show a preferred embodiment of the busbar 1 in which a respective connecting wall 12 is provided between one of the side walls 11 and the bearing wall 13. The connecting wall 12 extends at an acute angle 181 relative to the bearing wall 13 as shown in FIG. 1*a*. It connects the bearing wall 13 to the side wall 11. The busbar 1 therefore comprises a V-shaped portion, the tip of which (not shown) is flattened by the bearing wall 13. Due to the arrangement of the bearing wall 13 at a right angle to each of the side walls 11, the side walls 11 are also at a second acute angle 182 relative to the connecting walls 12.

Figure 4A:
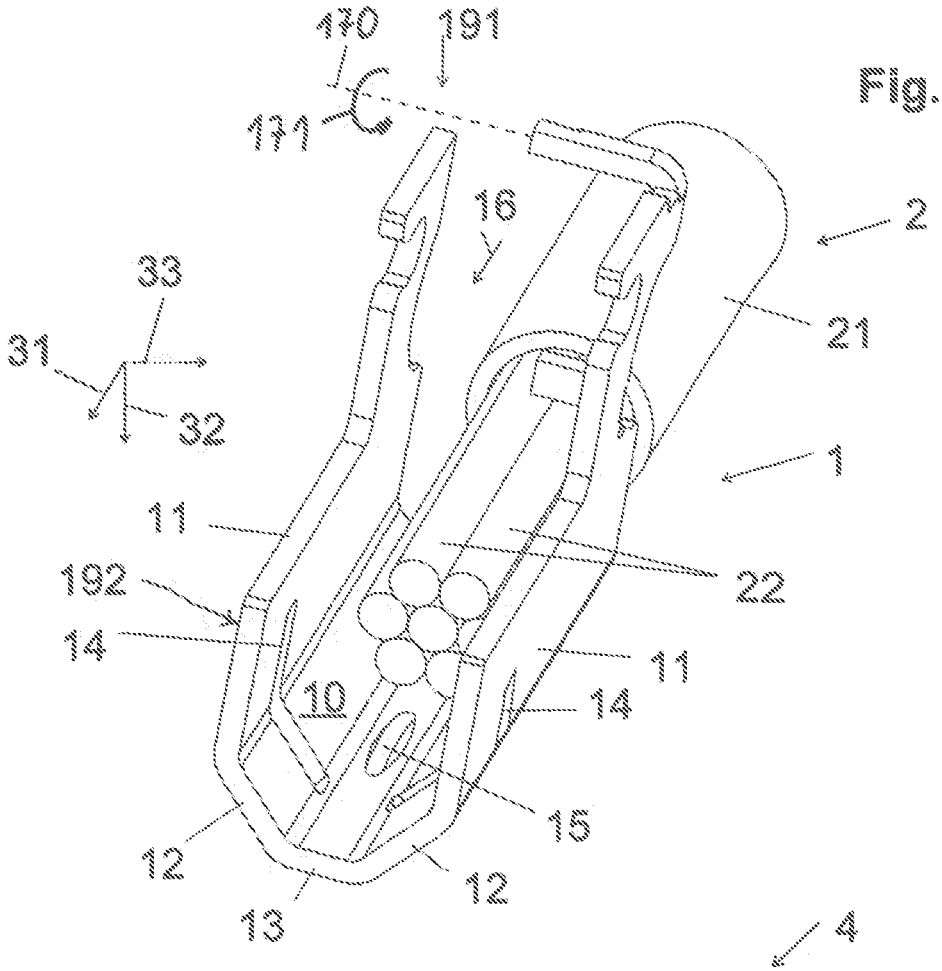
FIG. 4*a* is a perspective view of an electrical conductor during insertion in the busbar of FIG. 1.

An elevation or projection 15 is arranged at the bearing wall 13. The projection 15 has the shape of a longitudinal bump. It is arranged in the insertion direction 31 at or near an end 192 of the busbar 1 as shown in FIG. 4*a*.

The busbar 1 is in this case formed in one piece. This includes the projection 15. The projection 15 is in this case also formed in one piece with the walls 11, 12, 13. It is preferably made by embossing.

It can be seen that an electrical conductor 2 is inserted in a receiving space or chamber 10 of the busbar 1, which is defined by the side walls 11 and the bearing wall 13. The electrical conductor 2 is inserted into the chamber 10 at a start or first end 191 of the busbar 1 as shown in FIG. 4*a* in the insertion direction 31 through a conductor insertion opening 16. The electrical conductor 2 has an electrically insulating encasement or sheath 21 and a plurality, in this particular case seven, of electrically conductive strands 22. The strands 22 of this conductor 2 are thin, such that the width b of the lead portion (not labeled) formed of the strands 22 extends across less than half the distance a of the side walls 11 from each other. At its insertion end (not labeled), a part of the sheath 21 is stripped off, such that the strands 22 are exposed as shown in FIG. 4*a*. The width of the projection is preferably smaller than the width of the bearing wall.

FIG. 1*a* shows an off-center arrangement of the strands 22 in the chamber 10. One strand 22 abuts a connecting wall 12 and one strand 22 abuts the projection 15 in an electrically contacting manner. The lead portion is therefore arranged between the connecting wall 12 and the projection 15. The projection 15 disturbs the lead portion and causes a movement of the strands 22 relative to each other. This removes foreign layers (not shown) between the strands 22 and improves contact of the strands 22 among each other.

FIG. 1*b* shows an unfavorable contact situation. Without the projection 15, only three strands 22 arranged on top of each other and flush with the projection 15 would make electrical contact and contribute to the current carrying capacity. But the projection 15 causes an unstable position of the strands 22 to each other. The lead or the lower strand 22 slips off the projection 15, and the pack of strands regroups around the projection 15 as shown in FIG. 1*c* wherein two strands 22 arranged next to each other abut the projection 15 in an electrically contacting manner.

Figure 2A:
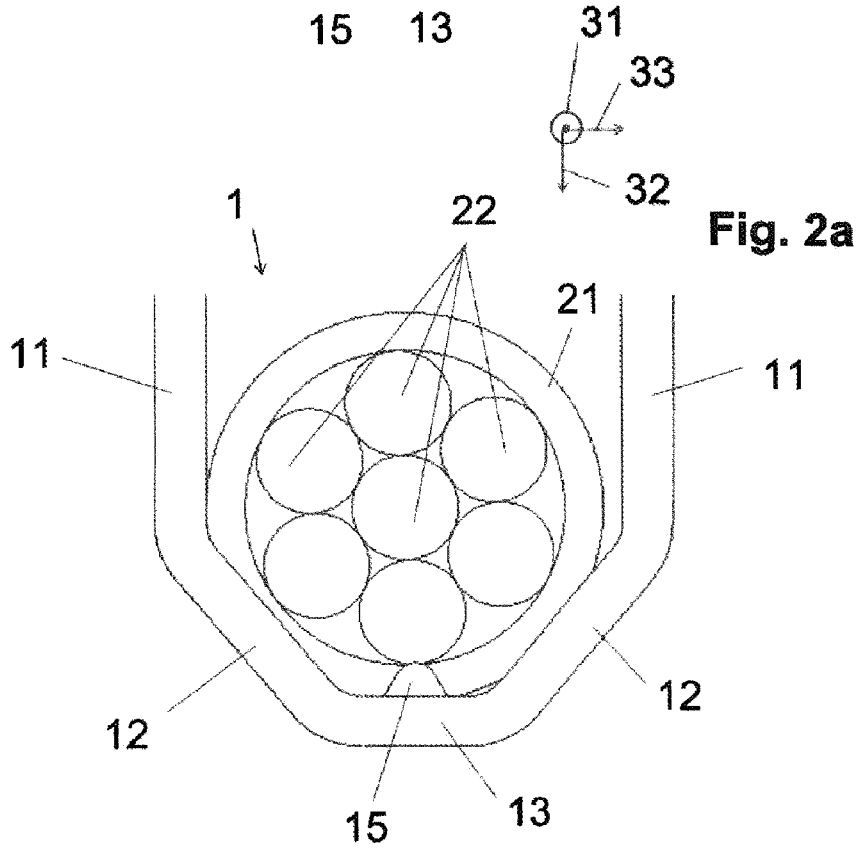
FIGS. 2*a* and 2*b* are end views of different portions of the busbar of FIG. 1 with a thick stranded conductor inserted therein.
Figure 2B:
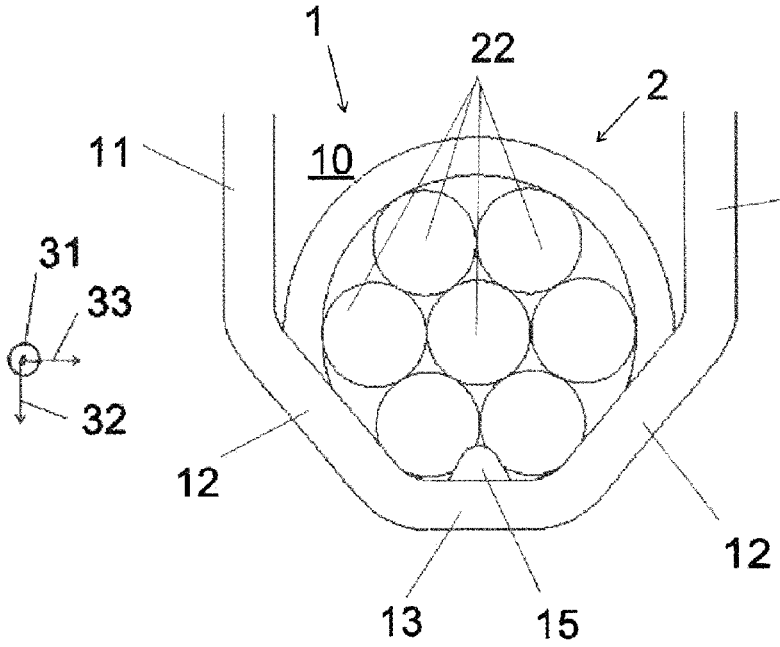

FIGS. 2*a* and 2*b* each show a different portion of the busbar 1 of FIG. 1 with a thick stranded conductor 2 inserted therein. Analogous to FIG. 1*b*, FIG. 2*a* shows an unfavorable contact situation in which only three strands 22 arranged flush with the projection 15 and on top of each other would make electrical contact if the busbar 1 did not have a projection 15. The projection 15 makes the relative position of the strands 22 unstable, such that the lead pack slips off the projection 15 and regroups around the projection 15 as shown in FIG. 2*b*.

Figure 3:
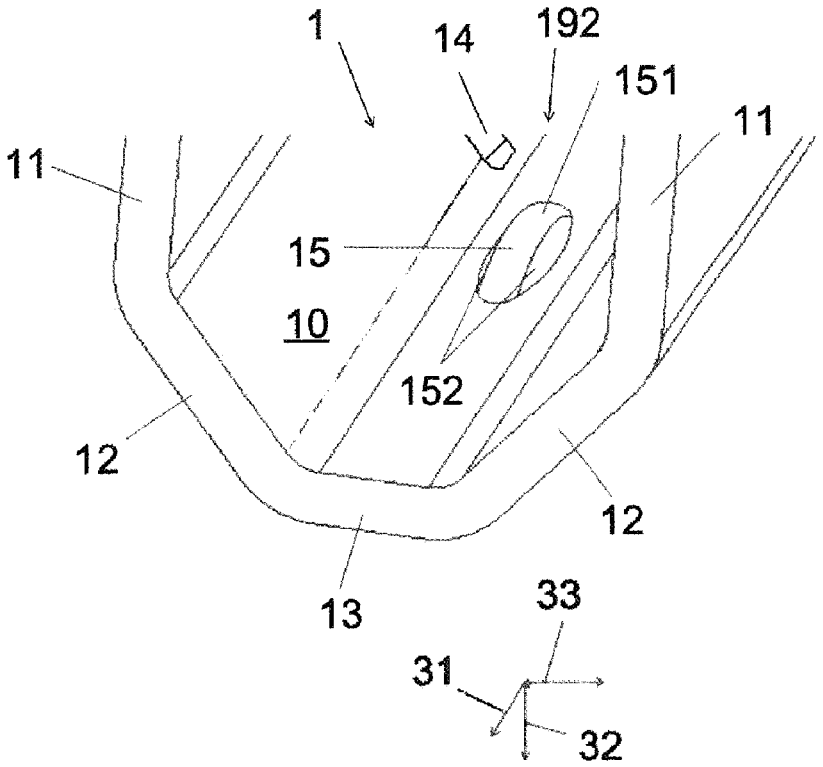
FIG. 3 is a perspective view of another portion of the busbar of FIG. 1.

FIG. 3 is a perspective view of another portion of the busbar 1 of FIG. 1. The projection 15 is arranged in the insertion direction 31 near the end 192 of the busbar 1. It roughly has an elliptical shape. It also has a flattened configuration. The projection in the insertion direction 31 therefore has a gently rising ramp (not labeled) and then a gently sloping ramp (not labeled). It has steeply dropping flanks or sides 152 which face the side walls 11. In this way, the stranded conductor 2 inserted over the projection 15 is gradually lifted and can easily slide off to the side via one of the flanks 152. This configuration is particularly advantageous. In addition, this configuration of the projection 15 is advantageous when inserting the stranded conductor 2 in the insertion direction 31 and when removing the stranded conductor 2 against the insertion direction 31. The projection 15 can also be drop-shaped, oval, or round. It can also be configured as a web (not shown) extending against the pressing direction 32 or a pin (not shown) or another shape which disturbs the arrangement of the strands 22 in the lead portion relative to each other. The extension of the projection 15 in the insertion direction 31 is preferably greater than the extension perpendicular thereto.

Figure 4B:
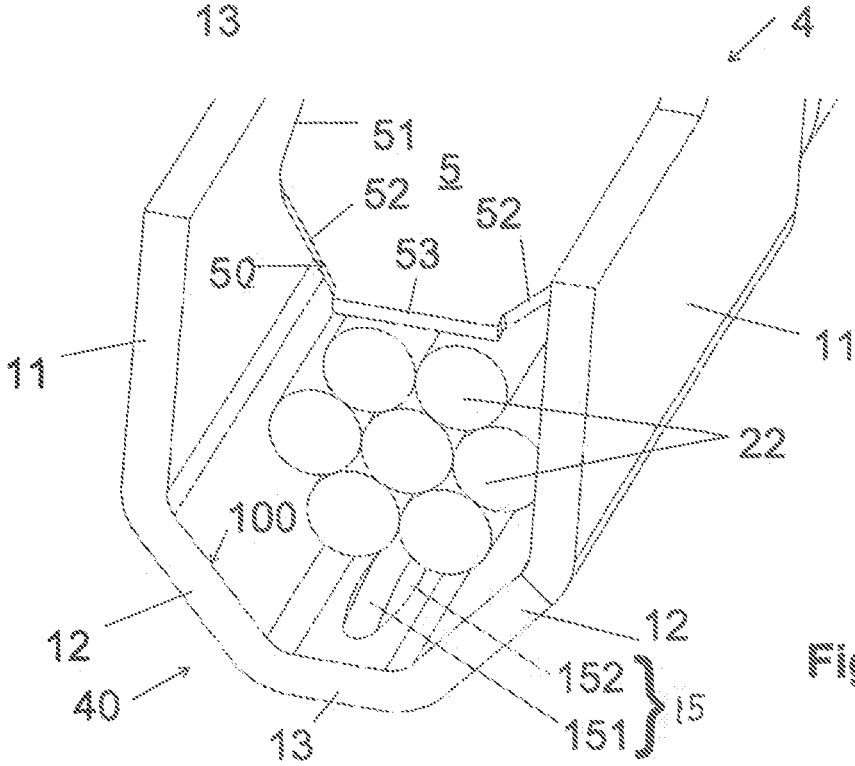
FIG. 4*b* is a detailed perspective view of a portion of a conductor terminal with the busbar of FIG. 4*a* and the electrical conductor inserted.
Figure 4C:
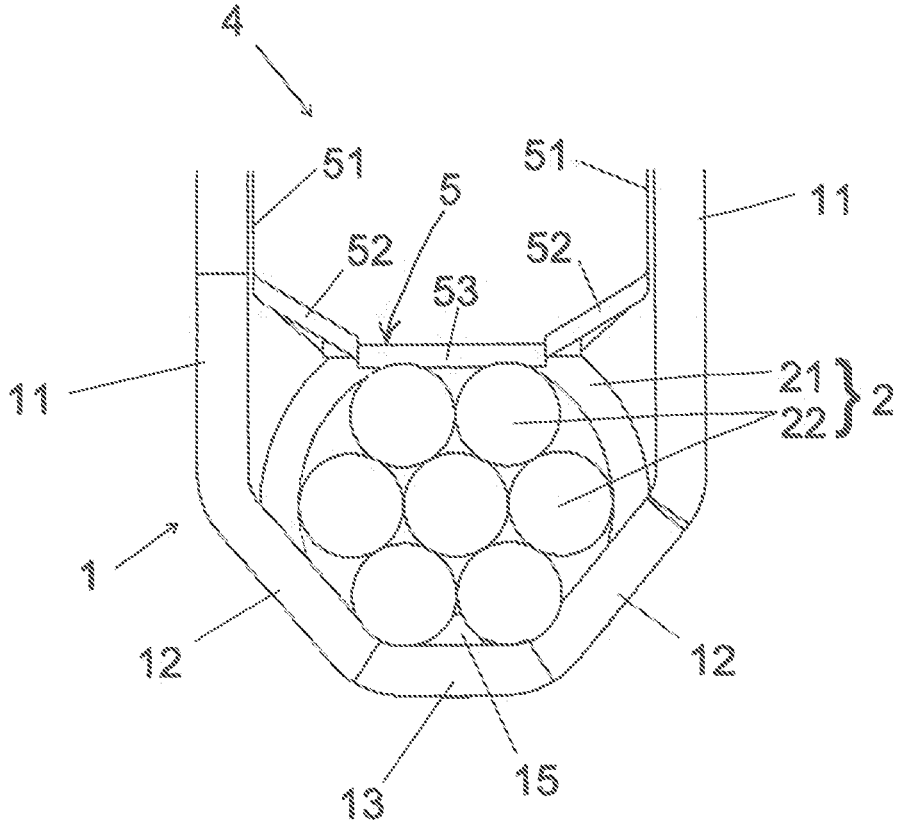
FIG. 4*c* is an end view of the conductor terminal of FIG. 4*a*.

FIG. 4*a* shows an electrical conductor 2 during insertion into the busbar 1 of FIG. 1, FIG. 4*b* is a perspective view of a portion of a conductor terminal 4 with the busbar 1 of FIG. 4*a* and the electrical conductor 2 inserted. The end face 40 of the conductor terminal 4 of is shown in FIG. 4*b*.

At the first end 191 of the busbar 1, the busbar includes a conductor insertion opening 16 through which the electrical conductor 2 is inserted into the chamber 10. The projection 15, which disturbs the arrangement of the strands 22 relative to each other in the lead portion of the conductor, is arranged near the end 192 of the busbar 1. Passage openings 14 in the form of slots are additionally provided in the insertion direction 31 downstream of the projection 15, but upstream of the end 192 of the busbar 1, through which openings a bearing web 61 (see FIG. 5) can be inserted. Such a bearing web 61 limits the movement of the electrical conductor 2 in the insertion direction 31 and acts as a stop.

FIG. 4*b* shows the portion of the conductor terminal 4 having the busbar 1 of FIG. 4*a* with the electrical conductor 2 inserted. It also shows a clamping leg 5 of a terminal spring. The clamping leg 5 presses the strands 22 of the electrical conductor 2 in the pressing direction 32 onto the busbar 1. Two of the strands 22 are grouped around and contact the projection 15 and a respective connecting wall 12. The disturbance and rubbing of the strands 22 against each other caused by the projection 15 ensures that there is good electrical contact between them. In this embodiment, all strands 22 of the electrical conductor 2 contribute to the current carrying capacity of the busbar.

The clamping leg 5 has a contour 50 that corresponds to an inner contour 100 of the chamber 10. Therefore, it has side edges 51 extending parallel to each other, a cross edge 53 extending transversely, and two connecting edges 52, which connect the cross edge 53 to a respective one of the side edges 51. Due to the corresponding shapes, the clamping leg 5 can completely enter the chamber 10 if no electrical conductor 2 is arranged in the chamber 10. The clamping leg 5 then almost fully penetrates the chamber 10. This means that the clamping leg 5 can be lifted even by a very thin electrical conductor 2 against its restoring force and against a pivoting direction 171 (see FIG. 4*a*), such that the electrical conductor 2 is clamped in the conductor terminal 4.

FIG. 4*b* shows the end face 40 of the conductor terminal 4 with an electrical conductor 2 clamped into the busbar 1. Due to the centering effect of the connecting walls 12 and the grouping of the strands 22 around the projection 15, the conductor 2 is arranged symmetrically relative to a central plane (not shown) extending in the insertion direction 31 and in the pressing direction 32 and centrally penetrating the receiving space 10 in the transverse direction 33. This allows the current to flow evenly distributed over the entire conductor 2.

Figure 5:
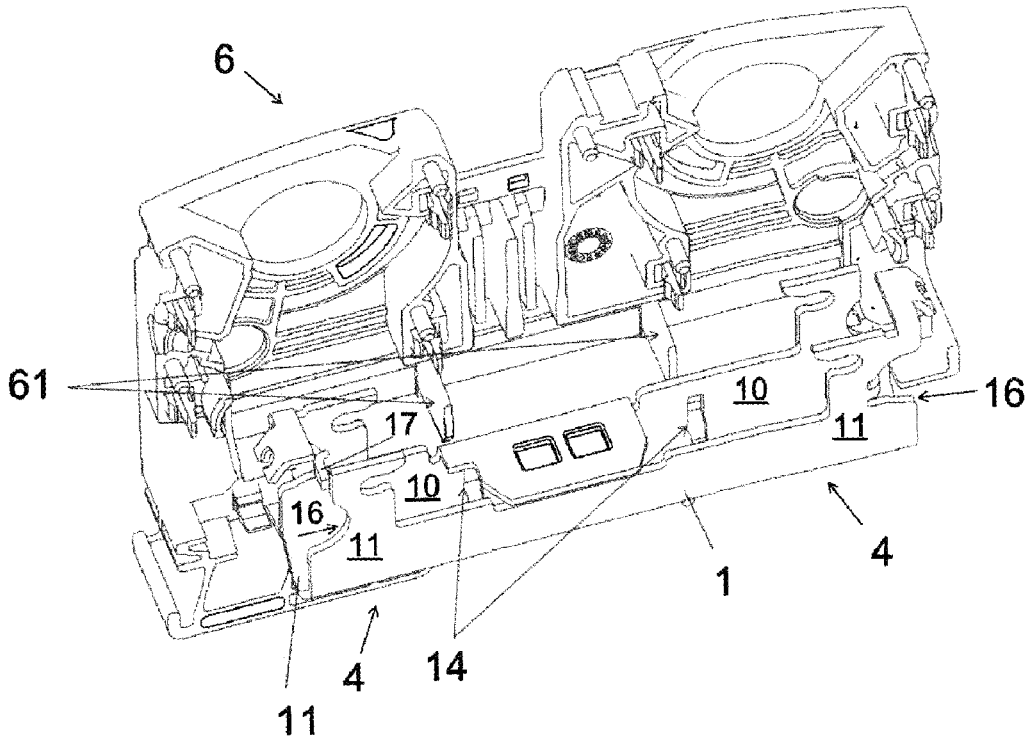
FIG. 5 is a perspective view of a portion of an electrical assembly having a busbar according to the invention.

FIG. 5 shows a portion of an electrical assembly 6 having a busbar 1 according to the invention. The assembly 6 is a series connecting terminal which can be mounted to a support rail (not shown). The busbar 1 is provided for connecting two electrical conductors 2. It is therefore configured at its opposing ends (not shown) in the manner shown in FIG. 4*a*.

Visible are the stop webs 61, shown here in a shortened form, which serve as stops for the electrical conductors 2 inserted in the busbar 1 and which penetrate the passage openings 14 of the busbar 1. The passage openings 14 each show the end 192 of a conductor terminal 4. The terminal springs are not shown for the sake of clarity.

The invention claimed is:

1. A spring force conductor terminal, comprising (1) a busbar for electrically contacting an electrical conductor, said busbar including (a) a pair of opposed side walls;

(b) a bearing wall extending transversely between the side walls and in an insertion direction to define a chamber for receiving the electrical conductor; and (c) at least one electrically conductive projection extending from the bearing wall, the at least one projection having a width less than a width of the bearing wall and a length greater than the projection width relative to the insertion direction and having side edges which are spaced from edges of the bearing wall, the at least one projection having one of an oval, elliptical, and drop-shaped contour whose surface tapers away from said bearing wall; and (2) a spring assembly for clamping the electrical conductor in the busbar chamber when the electrical conductor is inserted into the busbar.

2. The conductor terminal according to claim 1, wherein the side walls and the bearing wall are connected to each other to define the busbar with a U-shaped configuration.

3. The conductor terminal according to claim 1, and further comprising a connecting wall connected between each of the side walls and the bearing wall, the connecting walls extending at an acute first angle relative to the bearing wall to define the busbar with a substantially V-shaped configuration.

4. The conductor terminal according to claim 1, wherein the side and bearing walls are integral, whereby the busbar is a unitary punched and bent component.

5. The conductor terminal according to claim 1, wherein said the at least one projection is arranged at an end of the busbar in a conductor insertion direction.

6. The terminal according to claim 1, wherein said the at least one projection is flattened.

7. The conductor terminal according to claim 1, wherein the spring assembly comprises a clamping leg having a contour corresponding with an inner contour of the busbar which defines the chamber.

8. The conductor terminal according to claim 1, and further comprising a stop connected with the busbar within the chamber for engaging the electrical conductor after it has been inserted into the chamber.

* * * * *